US007481896B2

(12) United States Patent
Zhang

(10) Patent No.: US 7,481,896 B2
(45) Date of Patent: Jan. 27, 2009

(54) TORQUE TRANSFERRING LOW CARBON STEEL SHAFTS WITH REFINED GRAIN SIZE

(75) Inventor: Shun X. Zhang, Canton, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 388 days.

(21) Appl. No.: 11/416,963

(22) Filed: May 3, 2006

(65) Prior Publication Data

US 2007/0256766 A1 Nov. 8, 2007

(51) Int. Cl.
*C21D 9/28* (2006.01)

(52) U.S. Cl. ..... 148/319; 148/225; 148/229

(58) Field of Classification Search ..... 148/229, 148/225, 319

See application file for complete search history.

(56) References Cited

U.S. PATENT DOCUMENTS

| | | | | |
|---|---|---|---|---|
| 4,820,241 | A | 4/1989 | Nakamura | |
| 4,921,025 | A * | 5/1990 | Tipton et al. | 148/233 |
| 5,910,223 | A * | 6/1999 | Tipton et al. | 148/210 |
| 6,319,337 | B1 | 11/2001 | Yoshida et al. | |
| 6,390,924 | B1 | 5/2002 | Yoshida et al. | |

* cited by examiner

*Primary Examiner*—Deborah Yee

(57) ABSTRACT

A double carboaustempering combined with a martensite-producing quench provides plain-carbon and low alloy steel power transmission shafts with a carbon-rich exterior having a martensite and bainite microstructure and a substantially bainite interior. The shafts offer increased fatigue resistance.

14 Claims, 1 Drawing Sheet

TORQUE TRANSFERRING LOW CARBON STEEL SHAFTS WITH REFINED GRAIN SIZE

BACKGROUND OF THE INVENTION

1. Field of the Invention

The present invention is directed to torque transferring low carbon steel shafts, for example, drive shafts for motor vehicles, and to a process for their preparation by carboaustempering with grain refinement.

2. Background Art

It has been known for many centuries that the physical characteristics of steel are strongly dependent upon its thermal and mechanical history. Frequently, steel parts are provided in their final shape or near net shape, and thus mechanical operations such as forging, rolling, etc., cannot be further used to alter physical properties. However, thermal treatments are still available for use with such parts.

It is modernly understood that the microstructure of metals and metal alloys can be quite complex. Even in plain-carbon steel and other low alloy steels where carbon is the principal non-ferrous ingredient, a variety of phases are known to exist, for example, the cubic face centered structure of austenite and the body centered tetragonal structure of martensite, as well as ±-ferrite, cementite, ledeburite, pearlite, and bainite. Transformation of one phase to another may take place within certain temperature ranges, and often, the degree to which a transformation takes place will be markedly affected by quench rates. For example, if the quench rate is high, the steel may be "frozen" in a morphology which is incapable of being formed in samples which are slow cooled. For these reasons, there are a myriad of possible heat treatment processes, each of which generates its own combination of physical characteristics, such as hardness, tensile strength, elongation, ductility, etc. In addition, samples of steel having had different thermal histories can exhibit markedly different fatigue resistance.

In addition to heat treatments which can, depending upon part size and geometry, affect the entire structure, there are heat treatments which affect mainly the outside of the structure, for example, carburizing which may be used to surface harden parts ("case hardening") to achieve a more wear resistant and harder exterior combined with a more ductile interior.

Power transmission shafts must be strong and fatigue resistant. The stresses imparted to such shafts is rarely constant, and even in "constant speed" devices, the loads are generally cyclical. In the vehicle sector, loads can vary widely. Moreover, power transmission shafts often have features such as splines, holes for lubrication, etc., which often lower fatigue resistance at these points. The strength and resistance to fatigue for such parts can be increased by choosing a stronger alloy steel, but this solution involves considerable extra expense. A larger section shaft can also be used, but this solution uses more space, often restricted by design, and also involves a considerable weight penalty.

Typically, such shafts are induction hardened, as illustrated in U.S. Pat. Nos. 6,319,337 and 6,390,924, which employ induction hardened low alloy steel. However, with ever increasing loads coupled with the desire to keep weight as low as possible, induction hardening has not proven satisfactory in providing the fatigue resistance desired.

It would be desirable to provide steel power transmission shafts which offer improved fatigue resistance without employing highly alloyed steels, and without increasing the size and weight of the shaft.

SUMMARY OF THE INVENTION

It has now been surprisingly discovered that a multi-stage heat treatment process, in which an intermediate dwell which allows transformation into a mixture of bainite and martensite, and which separates two high temperature carboaustempering treatments, provides greatly improved fatigue resistance. The last of the carboaustempering treatments is followed by quenching to an additional low temperature regime whereby the carbon-rich case transforms to a mixture of bainite and martensite, while the interior, or "core" is substantially bainite. The shafts are then tempered.

DETAILED DESCRIPTION OF THE PREFERRED EMBODIMENTS

Figure 1:
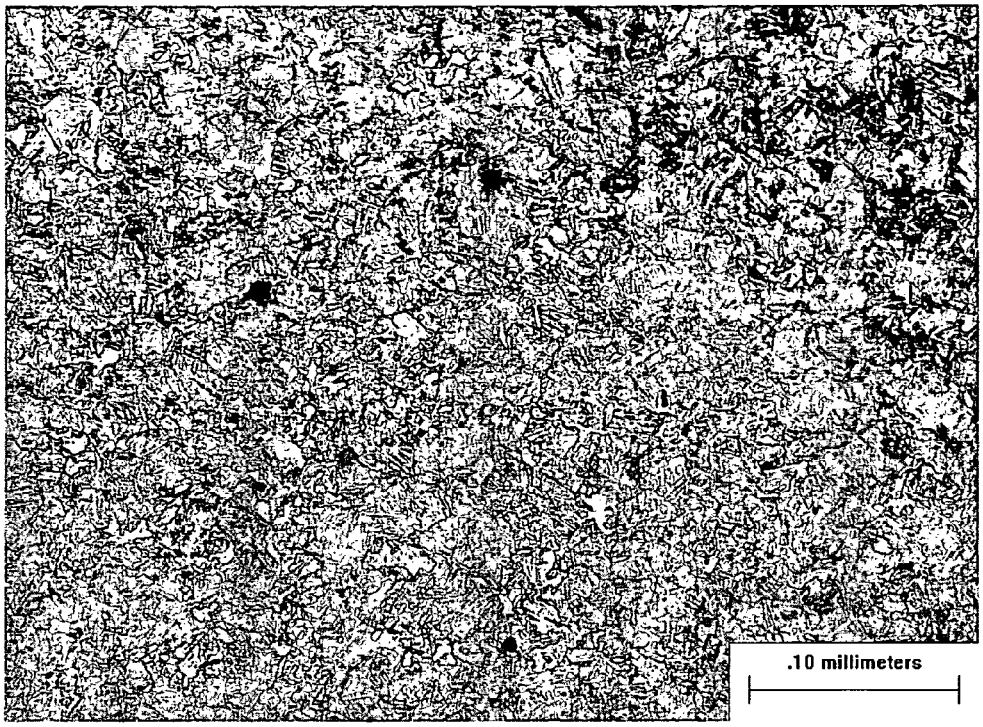
FIG. 1 is a photo micrograph of an interior of a torque transmission shaft of the invention, illustrating the grain structure.

The present invention is directed to a dual carboaustempering of torque transmission shafts of low alloy carbon steels or plain-carbon steels. Both of the latter types of steel are well known to the skilled artisan. Plain-carbon steel generally contains no other major alloying element other than carbon, and may be exemplified by SAE/AISI 10xx series steels. Low alloy steels have only minor amounts of alloying elements, and by the ISO definition, contain between 1% and 5% of elements deliberately added for the purpose of modifying properties. Non-limiting examples of low alloy steels include SAE/AISI 41xx, 43xx, 51xx, and 86xx series steels. Thus, the steels suitable for use in the present invention are carbon steels containing less than about 5 weight percent of purposefully added alloying ingredients. Typical alloying ingredients used in these minor amounts include, but are not limited to, silicon, vanadium, chromium, manganese, nickel, titanium, cobalt, and the like.

Torque transmitting shafts are likewise well known to the skilled artisan, and may be found, for example, in rigid axles, as well as in substantially exposed shafts in vehicles having independent suspension. The shafts are generally splined on at least one end, and often on both ends. One end may be equipped with a fork for a universal joint or other attachment means. Examples of power transmission shafts may be found in U.S. Pat. Nos. 6,319,337; 6,390,924; and 4,820,241, which are herein incorporated by reference. Such shafts may also be used in other applications such as large water pumps, stationary electrical generators, and the like.

The shafts are formed by conventional forging and machining steps, and are then heat-treated by the process of the invention. Some machining steps may be left until after heat treatment, if desired, but such steps generally do not include those which remove large amounts of surface material, since the microstructure is profiled and not constant throughout the part.

The steel shafts are first heated in a furnace to a temperature which will cause austenite transformation, e.g., 925° C.±50° C. A carbon-rich environment is provided by conventional methods. This is a carboaustempering process, and is well known. The shafts are held at this temperature for a period sufficient to develop a carbon-rich case on the shaft, preferably for a period of from 60 min. to 720 min., more preferably min. 360 to 600 min. The actual time of treatment necessary can be found by analysis of treated parts, and in general will vary with the type of steel, and also with part geometry, particularly thickness. The shafts are then rapidly quenched in molten salt to a temperature at which a phase transformation of austenite to a mixture of bainite and martensite occurs, e.g., 200° C.±50° C. The duration of this intermediate "dwell" is preferably from 30 min. to 120 min., more preferably 30 min. to 45 min., and as with carboaustempering, is both substrate and shape dependent.

Following the intermediate dwell, the shaft is again carboaustempered, for example, at 925° C.±50° C., but for a shorter time than before, for example, a period of 60 min. to 240 min., preferably from 60 min. to 120 min., and then again quenched and maintained at 200° C.±50° C., causing the case to transform to a microstructure containing both bainite and martensite, and the core to transform primarily to bainite. The shaft is held in the media for a time sufficient for this transfer to occur, for example, from 120 min. to 480 min., preferably 240 min. to 360 min.

Figure 2:
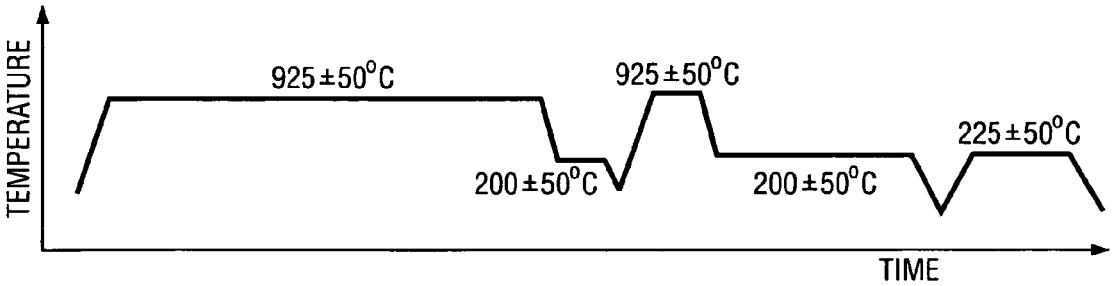
FIG. 2 is a schematic of the heat treating regime of the invention.

The shafts are then tempered, for example, at 225° C.±50° C., preferably from 30 min. to 150 min., more preferably 60 min. to 120 min. A schematic of the overall process is illustrated in FIG. 2.

Having generally described this invention, a further understanding can be obtained by reference to certain specific examples which are provided herein for purposes of illustration only and are not intended to be limiting unless otherwise specified.

A series of identical power transmission output shafts of SAE/AISI 8620 steel and 18 inch length as used in the General Motors 4L70E transmission were carboaustempered in a single stage (Comparative Examples C1-C6) and subjected to cyclical torque loadings at a frequency of 5 Hz as indicated in Table 1.

Also tested were shafts doubly carboaustempered by the process of the subject invention. The first carboaustempering took place at 925° for 495 min., followed by quenching in media to 200° and held for 30 min. The shaft was then replaced in the furnace and carboaustempered for the second time at 925° for 60 min., followed by quenching to 200° and holding for 260 min. Tempering then took place at 225° for 110 min. The results of the fatigue test are presented in Table 1.

TABLE 1

| Example | Max (Nm) | Min (Nm) | Description | Life, Cycles | Increase % |
|---|---|---|---|---|---|
| C1 | 1762 | −1762 | singly Carboaustempered | 97489 | — |
| 1 | 1762 | −1762 | double heat treated | 169245 | 74 |
| C2 | 1762 | −1762 | singly Carboaustempered | 118198 | — |
| 2 | 1762 | −1762 | double heat treated | 156887 | 33 |
| C3 | 1545 | −1545 | singly Carboaustempered | 200003 | — |
| 3 | 1545 | −1545 | double heat treated | 440972 | 120 |
| C4 | 1545 | −1545 | singly Carboaustempered | 447540 | — |
| 4 | 1545 | −1545 | double heat treated | 509131 | 14 |
| C5 | 1328 | −1328 | singly Carboaustempered | 1290084 | — |
| 5 | 1328 | −1328 | double heat treated | 2000000 | 554+ |
| C6 | 1328 | −1328 | singly Carboaustempered | 1301786 | — |
| 6 | 1328 | −1328 | double heat treated | 2950000 | 127+ |

* Test stopped

The results indicate that a very sizable increase in fatigue resistance occurs due to the heat treatment of the subject invention. On average, the fatigue resistance, as indicated by the number of cycles before failure, was greater by about 70%. Failure generally occurred, as expected, at a 4 mm lubricant hole or near a spline.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. In a power transmission shaft of plain carbon steel or low alloy steel, the improvement comprising heat treating the shaft by a heat treatment regime comprising the steps of:

a) a first carboaustempering at a temperature where austenite is formed;

b) a first quenching to a temperature at which bainite and martensite form, and holding at that temperature to cause formation of bainite and martensite;

c) a second carboaustempering at a temperature where austenite is formed;

d) a second quenching to a temperature at which bainite and martensite form and holding at that temperature to cause a carbon rich case formed in at least one of said first or said second carboaustemperings to transform to a microstructure comprising bainite and martensite, and to cause the interior of the shaft to form a microstructure primarily of bainite; and e) tempering the shaft.

2. The shaft of claim 1, wherein said carboaustemperings a) and c) are conducted at a temperature of 925° C.±50° C.

3. The shaft of claim 1, wherein said first quench and said second quench are to a temperature of 200° C.±50° C.

4. The shaft of claim 1, wherein said first carboaustempering takes place for a period of from 360 min. to 600 min.

5. The shaft of claim 1, wherein said second carboaustempering takes place for a period of from 60 min. to 120 min.

6. The shaft of claim 1, wherein the hold after the first quench takes place for from 30 min. to 45 min.

7. The shaft of claim 1, wherein an outer portion of said shaft is carbon-enriched as compared with the interior of the shaft, and comprises a mixture of bainite and martensite, and the interior of the shaft comprises bainite.

8. A process for increasing the fatigue resistance of a power transmission shaft, comprising:

a) providing a power transmission shaft;

b) carboaustempering a first time at a temperature where austenite is formed;

c) quenching a first time to a temperature and holding at that temperature to cause formation of bainite and martensite;

d) carboaustempering a second time at a temperature where austenite is formed;

e) quenching a second time to a temperature and holding at that temperature to cause a carbon rich case formed in at least one of said first or said second carboaustemperings to form a microstructure comprising bainite and martensite, and to cause the interior of the shaft to form a microstructure primarily of bainite; and f) tempering the shaft.

9. The process of claim 8, wherein said carboaustemperings b) and d) are conducted at a temperature of 925° C.±50° C.

10. The process of claim 8, wherein said first quenching and said second quenching are to a temperature of 200° C.±50° C.

11. The process of claim 8, wherein said first carboaustempering takes place for a period of from 360 min. to 600 min.

12. The process of claim 8, wherein said second carboaustempering takes place for a period of from 60 min. to 120 min.

13. The process of claim 8, wherein the hold after the first quench takes place for from 30 min. to 45 min.

14. The process of claim 8, wherein an outer portion of said shaft is carbon-enriched as compared with the interior of the shaft, and comprises a mixture of bainite and martensite, and the interior of the shaft comprises bainite.

* * * * *